US011230754B2

(12) United States Patent
Ohta et al.

(10) Patent No.: US 11,230,754 B2
(45) **Date of Patent: *Jan. 25, 2022**

(54) NANOCRYSTALLINE MAGNETIC ALLOY AND METHOD OF HEAT-TREATMENT THEREOF

(71) Applicants: METGLAS, INC., Conway, SC (US); HITACHI METALS, LTD., Tokyo (JP)

(72) Inventors: Motoki Ohta, Conway, SC (US); Naoki Ito, Myrtle Beach, SC (US)

(73) Assignees: METGLAS, INC., Conway, SC (US); HITACHI METALS, LTD., Tokyo (JP)

( * ) Notice: Subject to any disclaimer, the term of this patent is extended or adjusted under 35 U.S.C. 154(b) by 515 days.

This patent is subject to a terminal disclaimer.

(21) Appl. No.: 14/591,478

(22) Filed: Jan. 7, 2015

(65) Prior Publication Data

US 2016/0196907 A1 Jul. 7, 2016

(51) Int. Cl.

| | |
|---|---|
| ***H01F 1/147*** | (2006.01) |
| ***C21D 1/18*** | (2006.01) |
| ***H01F 41/02*** | (2006.01) |
| ***C22C 38/02*** | (2006.01) |
| ***C22C 38/16*** | (2006.01) |
| ***C22C 38/12*** | (2006.01) |
| ***C21D 6/00*** | (2006.01) |
| ***C22C 38/00*** | (2006.01) |
| ***H01F 1/153*** | (2006.01) |
| ***C21D 8/12*** | (2006.01) |
| *C22C 45/02* | (2006.01) |

(52) U.S. Cl.

CPC ..... *C22C 38/12* (2013.01); *C21D 1/18* (2013.01); *C21D 6/008* (2013.01); *C21D 8/125* (2013.01); *C21D 8/1244* (2013.01); *C22C 38/002* (2013.01); *C22C 38/02* (2013.01); *C22C 38/16* (2013.01); *H01F 1/15333* (2013.01); *C21D 8/1211* (2013.01); *C21D 2201/03* (2013.01); *C22C 45/02* (2013.01); *H01F 1/15308* (2013.01)

(58) Field of Classification Search

None

See application file for complete search history.

(56) References Cited

U.S. PATENT DOCUMENTS

| | | | |
|---|---|---|---|
| 5,072,205 | A | 12/1991 | Arakawa et al. |
| 5,611,871 | A | 3/1997 | Yoshizawa et al. |
| 5,911,840 | A | 6/1999 | Couderchon et al. |
| 6,425,960 | B1 | 7/2002 | Yoshizawa et al. |
| 8,007,600 | B2 | 8/2011 | Ohta et al. |
| 8,177,923 | B2 | 5/2012 | Ohta et al. |
| 8,287,666 | B2 | 10/2012 | Ohta et al. |
| 8,491,731 | B2 | 7/2013 | Makino |
| 2008/0196795 | A1 | 8/2008 | Waeckerle et al. |
| 2009/0266448 | A1 | 10/2009 | Ohta et al. |
| 2010/0043927 | A1 | 2/2010 | Makino |
| 2010/0023001 | A1 | 9/2010 | Yoshizawa et al. |
| 2011/0272065 | A1 | 11/2011 | Ohta et al. |
| 2012/0199254 | A1 | 8/2012 | Urata et al. |
| 2012/0318412 | A1 | 12/2012 | Ohta et al. |
| 2014/0104024 | A1 | 4/2014 | Herzer et al. |
| 2014/0152416 | A1 | 6/2014 | Herzer et al. |
| 2014/0191832 | A1 | 7/2014 | Ohta et al. |

FOREIGN PATENT DOCUMENTS

| | | |
|---|---|---|
| CN | 102282633 | 12/2011 |
| CN | 103502481 | 1/2014 |
| EP | 2 894 236 A1 | 7/2015 |
| JP | 5-3126 | 1/1993 |
| JP | 2004-353090 | 12/2004 |
| JP | 2004-353090 A | 12/2004 |
| JP | 2007-107095 | 4/2007 |
| JP | 2010-18976 | 9/2010 |
| JP | 2011-26706 | 2/2011 |
| JP | 2012-12699 | 1/2012 |
| JP | 2012-199506 | 10/2012 |
| JP | 5455040 | 1/2014 |
| JP | 2014-125675 | 7/2014 |
| JP | 2014-516386 | 7/2014 |
| JP | 2014-240516 | 12/2014 |
| JP | 2015-95500 | 5/2015 |
| JP | 2015-157999 | 9/2015 |
| WO | WO 2007/032531 A1 | 3/2007 |
| WO | WO 2008/13301 A1 | 11/2008 |

(Continued)

OTHER PUBLICATIONS

Office Action for U.S. Appl. No. 14/591,491 dated Aug. 16, 2017.
U.S. Appl. No. 14/591,491, filed Jan. 7, 2015, Ohta et al., (1) Metglas, Inc. and (2) Hitachi Metals, Ltd.
International Preliminary Report on Patentability dated Feb. 17, 2017 in corresponding International Patent Application No. PCT/US16/12181.
Written Opinion of the International Searching Authority for related PCT Application No. PCT/US16/12181, dated Mar. 16, 2016.
International Search Report for related PCT Application No. PCT/US16/12181, dated Mar. 16, 2016.
Written Opinion of the International Searching Authority for related PCT Application No. PCT/US16/12184, dated Apr. 1, 2016.
International Search Report for related PCT Application No. PCT/US16/12184, dated Apr. 1, 2016.

(Continued)

*Primary Examiner* — Anthony M Liang

(57) ABSTRACT

A nanocrystalline alloy ribbon has an alloy composition represented by $Fe_{bal}Cu_xB_ySi_zA_aX_b$ where $0.6 \le x < 1.2$, $10 \le y \le 20$, $0 < z \ge 10$, $10(y+z)24$, $0 \le a \le 10$, $O \le b \le 5$, with the balance being Fe and incidental impurities, where A is an optional inclusion of at least one element selected from Ni, Mn, Co, V, Cr, Ti, Zr, Nb, Mo, Hf, Ta and W, and X is an optional inclusion of at least one element selected from Re, Y, Zn, As, In, Sn, and rare earth elements, all numbers being in atomic percent. The ribbon has a local structure having nanocrystals with average particle sizes of less than 40 nm dispersed in an amorphous matrix, the nanocrystals occupying more than 30 volume percent of the ribbon and has a radius of ribbon curvature of at least 200 mm.

24 Claims, 5 Drawing Sheets

(56) References Cited

FOREIGN PATENT DOCUMENTS

| | | | |
|---|---|---|---|
| WO | WO 2008/133301 | A1 | 11/2008 |
| WO | WO 2009/123100 | A1 | 10/2009 |
| WO | WO 2011/122589 | A1 | 10/2011 |
| WO | WO 2012/140550 | A1 | 10/2012 |
| WO | WO 2014/038705 | A1 | 3/2014 |

OTHER PUBLICATIONS

Hitachi Metals, Ltd., "Nanocrystaltine soft magnetic material FINEMET", Printed Apr. 2005. Available online Mar. 11, 2006; Retrieved online: http://www.hilltech.com/pdf/hl-fm1Q-cFinemetIntro.pdf; pp. 1-12.
Francoeur, B et al., "Continuous-annealing method for producing a flexible, curved, soft magnetic amorphous alloy ribbon", Journal of Applied Physics, vol. 111. pp. 07A309-1-07A309-3, Feb. 14, 2012.
Griner, S et al., "Structure and properties changes of Fe78Si9B13 metallic glass by low-temperature thermal activation process", Journal of Achievements in Materials and Manufacturing Engineering, vol. 50. Issue 1, Jan. 1, 2012, pp. 18-25.
International Preliminary Report on Patentability for related PCT Application No. PCT/US16/12184, dated Dec. 30, 2016.
Taiwanese Office Action for a related Taiwanese Patent Application No. 105100422, dated Oct. 6, 2016.
Taiwanese Office Action for a related Taiwanese Patent Application No. 105100421, dated Mar. 30, 2017.
Office Action for U.S. Appl. No. 14/591,491 dated Feb. 10, 2017.
Extended European Search Report dated Jun. 13, 2018 in European Patent Application No. 16735298.8.
Extended European Search Report dated Jun. 13, 2018 in European Patent Application No. 16735299.6.
Chinese Office Action for a related Chinese Patent Application No. 201680008309.2, dated Oct. 8, 2018.
Communication from the European Patent Office dated Mar. 6, 2019 in European Patent Application No. 16 735 299.6.
Communication from the European Patent Office dated Mar. 6, 2019 in European Patent Application No. 16 735 298.8.
Japanese Office Action in Japanese Patent Application No. 2017-536007, dated Sep. 28, 2018.
Japanese Office Action in Japanese Patent Application No. 2017-536008, dated Oct. 3, 2018.
Chinese Office Action in Chinese Patent Application No. 201680008320.9, dated Nov. 21, 2018.
Chinese Second Patent Office Action issued in Chinese Patent Application No. 201680008320.9 dated Sep. 3, 2019.
Chinese Second Patent Office Action issued in Chinese Patent Application No. 201680008309.2 dated Jun. 5, 2019.
Communication pursuant to Article 94(3)EPC issued in European Patent Application No. 16 735 298.8 dated Sep. 30, 2019.
Communication pursuant to Article 94(3)EPC issued in European Patent Application No. 16 735 299.6 dated Sep. 30, 2019.
Notification of Decision of Rejection issued in Japanese Patent Application No. 2017-536007 dated May 24, 2019.
Notification of Decision of Rejection issued in Japanese Patent Application No. 2017-536008 dated Jun. 24, 2019.
Final Office Action dated Sep. 10, 2019 in related U.S. Appl. No. 14/591,491.
Final Office Action dated Apr. 12, 2019 in related U.S. Appl. No. 14/591,491.
Non-Final Office Action dated Oct. 2, 2018 in related U.S. Appl. No. 14/591,491.
Restriction Requirement dated Sep. 12, 2019 in related U.S. Appl. No. 14/591,491.
Taiwanese Notice of Allowance dated Apr. 10, 2017 in related Taiwanese Application No. 105100422.
Taiwanese Notice of Allowance dated Oct. 19, 2017 in related Taiwanese Application No. 105100421.
Japanese Notice of Allowance dated Nov. 27, 2019 in related Japanese Application No. 2017-536007.
Third Chinese Patent Office Action dated Feb. 25, 2020 in related Chinese Patent Application No. 201680008309.2.
Non-Final Office Action dated Jul. 2, 2020 in U.S. Appl. No. 14/591,491.
Communication under Article 94(3) EPC dated Jul. 24, 2020 in European Patent Application No. 16735298.8.
Notice of Allowance dated Jul. 6, 2020 in Chinese Patent Application No. 201680008309.2.
Communication under Rule 71(3) EPC dated Mar. 3, 2020 in European Patent Application No. 16735299.6.
Third Office Action dated May 7, 2020 in Chinese Patent Application No. 201680008320.9.
Final Office Action dated Feb. 24, 2021 in co-pending U.S. Appl. No. 14/591,491 (43 pages).
Communication under Rule 71(3) EPC (Notice of Allowance) dated Mar. 10, 2021 in European Patent Application No. 16735298.8 (32 pages).
Notice of Allowance dated Feb. 3, 2021 in Chinese Patent Application No. 201680008320.9 (1 page) (1 page English Translation).
Notice of Allowance dated Mar. 4, 2021 in Japanese Patent Application No. 2019-14151 (3 pages) (8 pages English Translation).
Non-Final Office Action dated Jul. 12, 2021 in U.S. Appl. No. 14/591,491 (45 pages).
Notice of Reasons for Rejection dated Sep. 14, 2021 in Korean Patent Application No. 10-2017-7021442.
Notice of Reason for Rejection dated Oct. 1, 2021 in Korean Patent Application No. 10-2017-7021729.
Examination Report dated Oct. 7, 2021 in Indian Patent Application No. 201747023542.
Office Action dated Nov. 22, 2021 in Korean Patent Application No. 10-2017-7021442+ (3 pages).

NANOCRYSTALLINE MAGNETIC ALLOY AND METHOD OF HEAT-TREATMENT THEREOF

BACKGROUND

1. Field

Embodiments of the invention relate to a nanocrystalline magnetic alloy having a high saturation induction, low coercivity and low iron-loss, a magnetic component based on the alloy, and a method of heat-treatment thereof.

2. Description of Related Art

Crystalline silicon steels, ferrites, cobalt-based amorphous soft magnetic alloys, iron-based amorphous and nanocrystalline alloys have been widely used in magnetic inductors, electrical choke coils, pulse power devices, transformers, motors, generators, electrical current sensors, antenna cores and electromagnetic shielding sheets. Widely used silicon steels are inexpensive and exhibit high saturation induction but are lossy in high frequencies. One of the causes for high magnetic losses is that their coercivity $H_c$ is high, at about 5 A/m. Ferrites have low saturation inductions and therefore magnetically saturate when used in high power magnetic inductors. Cobalt-based amorphous alloys are relatively expensive and result in saturation inductions of usually less than 1 T. Because of their lower saturation inductions, magnetic components constructed from cobalt-based amorphous alloys need to be large in order to compensate the low levels of operating magnetic induction, which is lower than the saturation induction, $B_s$. Iron-based amorphous alloys have $B_s$ of 1.5-1.6 T, which are lower than $B_s$~2 T for silicon steels. As summarized above, clearly needed is a magnetic alloy having a saturation induction exceeding 1.6 T, and a coercivity $H_c$ of less than 5 A/m.

An iron-based nanocrystalline alloy having a high saturation induction and a low coercivity has been taught in international application patent publication WO2007/032531 (hereinafter "the '531 publication"). This alloy has a chemical composition of $Fe_{100-x-y-z}Cu_xB_yX_z$ (X: at least one from the group consisting of Si, S, C, P, Al, Ge, Ga, and Be) where x, y, z are such that $0.1 \le x \le 3$, $10 \le y \le 20$, $0 < z \le 10$ and $10 < y+z \le 24$ (all in atom percent) and has a local structure in which crystalline particles with average diameters of less than 60 nm are distributed occupying more than 30 volume percent of the alloy. This alloy contains copper, but its technological role in the alloy was not clearly demonstrated. It was thought at the time of the '531 publication that copper atoms formed atomic clusters serving as seeds for nanocrystals that grew in their sizes by post-material fabrication heat-treatment into having local structures defined in the '531 publication. In addition, it was thought that the copper clusters could exist in the molten alloy due to copper's heat of mixing being positive with iron according to conventional metallurgical law, which determined the upper copper content in the molten alloy. However, it later became clear that copper reached its solubility limit during rapid solidification and therefore precipitated, initiating a nanocrystallization process. Under a super-cooled condition, in order to achieve an envisaged local atomic structure that enables initial nanocrystallization upon rapid solidification, the copper content, x, must be between 1.2 and 1.6. Thus the copper content range of $0.1 \le x \le 3$ in the '531 publication has been greatly reduced. As a matter of fact, an alloy of the '531 publication was found brittle due to partial crystallization and therefore difficult to handle, although the magnetic properties obtained were acceptable. In addition, it was found that stable material casting was difficult because rapid solidification condition for the alloy of the '531 publication varied greatly by solidification speed. Thus improvements over the products of the '531 publication have been desired.

SUMMARY

In the process of improving over the products of the '531 publication, it was found that fine nanocrystalline structures were formed in an alloy in accordance with embodiments of the present invention by rapid heating-up of the alloy originally having no cast-in fine crystalline particles. Also found was that the heat-treated alloy exhibited excellent soft magnetic properties, such as high saturation inductions exceeding 1.7 T.

The nanocrystallization mechanism in an alloy according to embodiments of the present invention is different from that of related art alloys (see, for example, U.S. Pat. No. 8,007,600 and international patent publication WO2008/133301) in that substitution of glass-forming elements such as P and Nb by other elements results in enhancement of thermal stability of the amorphous phase formed in the alloy during crystallization. Furthermore, the element substitution suppresses growth of the crystalline particles precipitating during heat-treatment. In addition, rapid heating of alloy ribbon reduces atomic diffusion rate in the material, resulting in reduced number of crystal nucleation sites. It is difficult for the element P to maintain its purity in the material. P tends to diffuse at temperatures below 300° C., reducing alloy's thermal stability. Thus, P is not a desirable element in the alloy. Elements such as Nb and Mo are known to improve the formability of an Fe-based alloy in glassy or amorphous states but tend to decrease the saturation induction of the alloy as they are non-magnetic and their atomic sizes are large. Thus, the contents of these elements in the preferred alloys should be as low as possible.

One aspect of the present invention is to develop a process in which the heating rate during the alloy's heat-treatment is increased, by which magnetic loss such as core loss is reduced in the nanocrystallized material, providing a magnetic component with improved performance.

Considering the effects of constituent elements described in the preceding paragraphs, an alloy may have the chemical composition of $Fe_{100-x-y-z}Cu_xB_ySi_z$ where $0.6 \le x < 1.2$, $10 \le y \le 20$, $0 < z \le 10$, $10 \le (y+z) \le 24$, the numbers being in atomic percent. The alloy may be cast into ribbon form by the rapid solidification method taught in U.S. Pat. No. 4,142,571.

A rapidly solidified ribbon having the chemical composition given in the preceding paragraph may be heat-treated first at temperatures between 450° C. and 500° C. by directly contacting the ribbon on a metallic or ceramic surface in an chamber, followed by a rapid heating of the ribbon at a heating rate of 10° C./sec. above 300° C. An example of primary annealing temperature profile is given in the left-hand side of FIG. 1. In this figure, a time span of 1 sec for the primary anneal at 500° C. is indicated by "A".

The heat-treatment process described above produces a local structure such that nanocrystals with average particles sizes of less than 40 nm were dispersed in the amorphous matrix occupying more than 30 volume percent and the radius of ribbon curvature was more than 200 mm.

A heat-treated ribbon with the above described nanocrystals has a magnetic induction at 80 A/m exceeding 1.6 T, a saturation induction exceeding 1.7 T and coercivity $H_c$ of less than 6.5 Nm. In addition, the heat-treated ribbon exhibited a core loss at 1.5 T and 50 Hz of less than 0.27 W/kg.

In accordance with a first aspect of the invention, a nanocrystalline alloy ribbon has: an alloy composition represented by $Fe_{bal}$, $Cu_xB_ySi_zA_aX_b$ where $0.6 \le x \le 1.2$, $10 \le y \le 20$, $0 < z \le 10$, $10 \le (y+z) \le 24$, $0 \le a \le 10$, $0 \le b \le 5$, with the balance being Fe and incidental impurities, where A is an optional inclusion of at least one element selected from Ni, Mn, Co, V, Cr, Ti, Zr, Nb, Mo, Hf, Ta and W, and X is an optional inclusion of at least one element selected from Re, Y, Zn, As, In, Sn, and rare earth elements, all numbers being in atomic percent; a local structure having nanocrystals with average particle sizes of less than 40 nm dispersed in an amorphous matrix, the nanocrystals occupying more than 30 volume percent of the ribbon; and a radius of ribbon curvature of at least 200 mm.

In a second aspect of the invention, the nanocrystalline alloy ribbon according to the first aspect of the invention has a $B_{80}/B_s$ ratio of 0.92 to 0.98, where $B_{80}$ is magnetic induction at 80 Nm.

In a third aspect of the invention, the nanocrystalline alloy ribbon according to the first or second aspects of the invention has a magnetic induction at 80 Nm exceeding 1.6 T, a saturation induction $B_s$ exceeding 1.7 T, and a coercivity $H_c$ of less than 6.5 A/m.

In a fourth aspect of the invention, the nanocrystalline alloy ribbon according to any one of the first through third aspects of the invention has been heat treated and exhibiting a core loss at 1.5 T and 50 Hz of less than 0.27 W/kg.

In a fifth aspect of the invention, in the nanocrystalline alloy ribbon according to any one of the first through fourth aspects of the invention, the content of Fe exceeds 75, preferably 77, more preferably 78 atomic percent.

In a sixth aspect of the invention, in the nanocrystalline alloy ribbon according to any one of the first through fifth aspects of the invention, the alloy composition consists of the elements Fe, Cu, B, and Si and incidental impurities.

In a seventh aspect of the invention, in the nanocrystalline alloy ribbon according to any one of the first to sixth aspects of the invention, "a" ranges from 0.01 atomic percent to 10 atomic percent, preferably from 0.01 atomic percent to 3 atomic percent.

In an eighth aspect of the invention, in the nanocrystalline alloy ribbon according to the seventh aspect, "a" ranges from 0.01 atomic percent to 1.5 atomic percent.

In a ninth aspect of the invention, in the nanocrystalline alloy ribbon according to any one of the first through eighth aspects of the invention, a collective content of Nb, Zr, Ta and Hf in the alloy composition is below 0.4, preferably below 0.3 atomic percent.

In a tenth aspect of the invention, in the nanocrystalline alloy ribbon according to any one of the claims first through ninth aspects of the invention, b is less than 2.0 atomic percent.

In an eleventh aspect of the invention, in the nanocrystalline alloy ribbon according to any one of the first through tenth aspects of the invention, b is less than 1.0 atomic percent.

In a twelfth aspect of the invention, the nanocrystalline alloy ribbon according to any one of the first through eleventh aspects of the invention has been heat-treated first by an average heating rate of more than 50° C./sec. from at least room temperature, preferably from 300° C., to a predetermined holding temperature which exceeds 430° C. preferably higher than 450° C. and which is less than 550° C. preferably less than 520° C., with the holding time of less than 90 minutes, preferably less than 30 minutes.

In a thirteenth aspect of the invention, the nanocrystalline alloy ribbon according to the twelfth aspect of the invention has been heat-treated first by the average heating rate of more than 50° C./sec. from 300° C. to a predetermined holding temperature which exceeds 450° C. and which is less than 520° C., with the holding time of less than 10 minutes.

In a fourteenth aspect of the invention, the nanocrystalline alloy ribbon according to the twelfth or thirteenth aspect of the invention has been treated using a magnetic field applied during the heat-treatment, the field applied being high enough to magnetically saturate the ribbon and being preferably higher than 0.8 kA/m either in DC, AC or pulse form, and the direction of the applied field is predetermined depending on the need for a square, round or linear BH loop.

In a fifteenth aspect of the invention, the nanocrystalline alloy ribbon according to the twelfth or thirteenth aspect of the invention has been produced with a mechanical tension higher than 1 MPa and less than 500 MPa applied to the ribbon.

In a sixteenth aspect of the invention, the nanocrystallline alloy ribbon according to any one of the twelfth through fifteenth aspects of the invention has been treated with a secondary heat-treatment performed at a temperature between 400° C. and 500° C. for a duration shorter than 30 minutes.

In a seventeenth aspect of the invention, a method includes: heating a nanocrystalline alloy ribbon at an average heating rate of more than 50° C./sec. from room temperature or higher to a predetermined holding temperature ranging from 430° C. to 530° C., the ribbon having an alloy composition represented by $Fe_{bal}Cu_xB_ySi_zA_aX_b$ where $0.6 \le x < 1.2$, $10 \le y \le 20$, $0 < z \ge 10$, $10(y+z)24$, $0 \le a \le 10$, $O \le b \le 5$, with the balance being Fe and incidental impurities, where A is an optional inclusion of at least one element selected from Ni, Mn, Co, V, Cr, Ti, Zr, Nb, Mo, Hf, Ta and W, and X is an optional inclusion of at least one element selected from Re, Y, Zn, As, In, Sn, and rare earth elements, all numbers being in atomic percent; and holding the ribbon at the holding temperature for less than 90 min.

In an eighteenth aspect of the invention, in the method according to the seventeenth aspect of the invention, the heating rate ranges from 80 to 100° C./sec.

In a nineteenth aspect of the invention, in the method according to the seventeenth or eighteenth aspect of the invention, the combined duration of the heating and the holding is from 3 to 15 seconds.

In a twentieth aspect of the invention, in the method according to any one of the seventeenth through nineteenth aspects of the invention, a magnetic field is applied during the heating, the field applied being high enough to magnetically saturate the ribbon and being preferably higher than 0.8 kA/m either in DC, AC or pulse form, and the direction of the applied field is predetermined depending on the need for a square, round or linear BH loop;

In a twenty-first aspect of the invention, in the method according to any one of the seventeenth through nineteenth aspect of the invention, a mechanical tension ranging from 1 to 500 MPa is applied during the heating.

In a twenty-second aspect of the invention, in the method according to any one of the seventeenth through twenty-first aspects of the invention, the heating is performed in an environment having an oxygen gas content between 6% and 18%, or more preferably between 8% and 15%.

In a twenty-third aspect of the invention, in the method according to any one of the seventeenth through twenty-second aspects of the invention, the oxygen gas content is between 9% and 13%.

In a twenty-fourth aspect of the invention, the method according to any one of the seventeenth through twenty-third aspects of the invention further includes: after the heating, performing a second heating at a temperature between 400° C. and 500° C. for a duration of 30 minutes or shorter.

BRIEF DESCRIPTION OF THE DRAWINGS

The invention will be more fully understood and further advantages will become apparent when reference is made to the following detailed description of an embodiments and the accompanying drawing in which.

DESCRIPTION OF EMBODIMENTS

Figure 1:
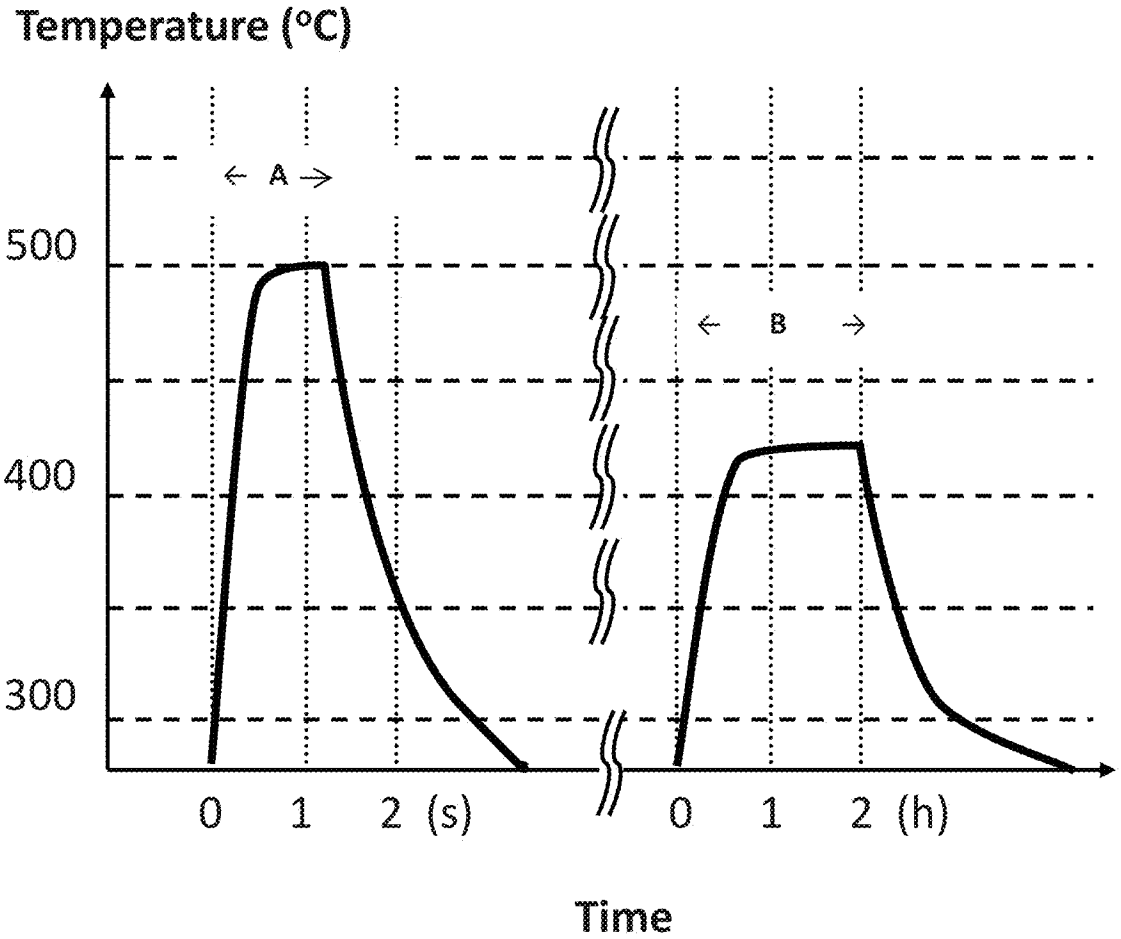
FIG. 1 shows temperature profiles for the primary annealing on the left-hand side and for the secondary annealing on the right-hand side. Examples of holding time of about 1 sec. at 500° C. and of about 90 minutes at 430° C. are indicated by "A" and "B", respectively.

A ductile metallic ribbon as used in embodiments of the invention may be cast by a rapid solidification method described in U.S. Pat. No. 4,142,571. The ribbon form is suitable for post ribbon-fabrication heat treatment, which is used to control the magnetic properties of the cast ribbon.

This composition of the ribbon comprises Cu in an amount of 0.6 to 1.2 atomic percent, B in an amount of 10 to 20 atomic percent, and Si in an amount greater than 0 atomic percent and up to 10 atomic percent, where the combined content of B and Si ranges from 10 through 24 atomic percent. The alloy may also comprise, in an amount of up to 0.01-10 atomic percent (including values within this range, such as a values in the range of 0.01-3 and 0.01-1.5 at %), at least one element selected from the group of Ni, Mn, Co, V, Cr, Ti, Zr, Nb, Mo, Hf, Ta and W. When Ni is included in the composition, Ni may be in the range of 0.1-2 or 0.5-1 atomic percent. When Co is included, Co may be included in the range of 0.1-2 or 0.5-1 atomic percent. When an element selected from the group of Ti, Zr, Nb, Mo, Hf, Ta and W is included, the total content of these elements may be at any value below 0.4 (including any value below 0.3, and below 0.2) atomic percent in total. The alloy may also comprise, in an amount of any value up to and less than 5 atomic percent (including values less up to and than 2, 1.5, and 1 atomic percent), at least one element selected from the group of Re, Y, Zn, As, In, Sn, and rare earths elements.

Each of the aforementioned ranges for the at least one element selected from the group of Ni, Mn, Co, V, Cr, Ti, Zr, Nb, Mo, Hf, Ta and W (including the individually given ranges for Co and Ni) may coexist with each of the above-given ranges for the at least one element selected from the group of Re, Y, Zn, As, In, Sn, and rare earths elements. In any of the compositional configurations given above, the elements P and Nb may be excluded from the alloy composition. In any of the compositional variations, including those discussed above, the Fe content may be in an amount of at least 75, 77 or 78 atomic percentage.

An example of one composition range suitable for embodiments of the present invention is 80-82 at. % Fe, 0.8-1.1 at. % or 0.9-1.1 at. % Cu, 3-5 at. % Si, 12-15 at. % B, and 0-0.5 at. % collectively constituted of one or more elements selected from the group of Ni, Mn, Co, V, Cr, Ti, Zr, Nb, Mo, Hf, Ta and W, where the aforementioned atomic percentages are selected so as to sum to 100 at. %, aside from incidental or unavoidable impurities.

The alloy composition may consist of or consist essentially of only the elements specifically named in the preceding three paragraphs, in the given ranges, along with incidental or unavoidable impurities. The alloy composition may also consist of or consist essentially of only the elements Fe, Cu, B, and Si, in the above given ranges for these particular elements, along with incidental or unavoidable impurities. The presence of any incidental impurities, including practically unavoidable impurities, is not excluded by any composition of the claims. If any of the optional constituents (Ni, Mn, Co, V, Cr, Ti, Zr, Nb, Mo, Hf, Ta, W, Re, Y, Zn, As, In, Sn, and rare earths elements) are present, they may be present in an amount that is at least 0.01 at. %.

In embodiments of the invention, the chemical composition of the ribbon can be expressed as $Fe_{100-x-y-z}Cu_xB_ySi_z$ where $0.6 \le x < 1.2$, $10 \le y \le 20$, $0 < z \le 10$, $10 \le (y+z) \le 24$, all numbers being in atomic percent.

A Cu content of $0.6 \le x < 1.2$ is utilized because Cu atoms formed clusters serving as seeds for fine crystalline particles of bcc Fe, if $x \ge 1.2$. The size of such clusters, which affected the magnetic properties of a heat-treated ribbon, was difficult to control, Thus, x is set to be below 1.2 atomic percent. Since a certain amount of Cu was required to induce nanocrystallization in the ribbon by heat-treatment, it was determined that $Cu \ge 0.6$.

Because of the positive heat of mixing in the amorphous Fe—B—Si matrix, Cu atoms tended to cluster to reduce boundary energy between the matrix and the Cu cluster phases. In the prior art alloys, elements such as P or Nb were added to control the diffusion of Cu atoms in the alloys. These elements may be eliminated or minimized in the alloys in embodiments of the present invention as they reduced the saturation magnetic inductions in the heat-treated ribbon. Therefore, either one or both of the elements P and Nb may be absent from the alloy, or absent except in amounts that are incidental or unavoidable. Alternatively, instead of having P be absent, P may be included in the minimized amounts discussed in this disclosure.

Instead of controlling Cu diffusion by adding P or Nb to the alloys as described earlier, the heat-treatment process was modified in such a way that rapid heating of the ribbon did not allow for Cu atoms to have enough time to diffuse.

In the previously recited composition of $Fe_{100-x-y-z}Cu_xB_ySi_z$ ($0.6 \le x < 1.2$, $10 \le y \le 20$, $0 < z \le 10$, $10 \le (y+z) \le 24$), the Fe content should exceed or be at least 75 atomic percent, preferably 77 atomic percent and more preferably 78 atomic percent in order to achieve a saturation induction of more than 1.7 T in a heat-treated alloy containing bcc-Fe nanocrystals, if such saturation induction is desired. As long as the Fe content is enough to achieve the saturation induction exceeding 1.7 T, incidental impurities commonly found in Fe raw materials were permissible. These amounts of Fe being greater than 75, 77, or 78 atomic percent may be implemented in any composition of this disclosure, independently of the inclusion of Ni, Mn, Co, V, Cr, Ti, Zr, Nb, Mo, Hf, Ta and W, and of Re, Y, Zn, As, In, Sn, and rare earths elements discussed below.

In the previously recited composition of $Fe_{100-x-y-z}Cu_xB_ySi_z$ ($0.6 \le x < 1.2$, $10 \le y \le 20$, $0 < z \le 10$, $10 \le (y+z) \le 24$), up to from 0.01 atomic percent to 10 atomic percent, preferably up to 0.01-3 atomic percent and most preferably up to 0.01-1.5 atomic percent of the Fe content denoted by $Fe_{100-x-y-z}$ may be substituted by at least one selected from the group of Ni, Mn, Co, V, Cr, Ti, Zr, Nb, Mo, Hf, Ta and W. Elements such as Ni, Mn, Co, V and Cr tended to be alloyed into the amorphous phase of a heat-treated ribbon, resulting in Fe-rich nanocrystals with fine particle sizes and, in turn, increasing the saturation induction and enhancing the soft magnetic properties of the heat-treated ribbon. The presence of these elements (including in the ranges of individual elements discussed below) may exist in combination with the total Fe content being in an amount greater than 75, 77 or 78 atomic percentage.

Of the Fe substitution elements Ni, Mn, Co, V, Cr, Ti, Zr, Nb, Mo, Hf, Ta and W discussed above, Co and Ni additions allowed increase of Cu content, resulting in finer nanocrystals in the heat-treated ribbon and, in turn, improving the soft magnetic properties of the ribbon. In the case of Ni, its content was preferably from 0.1 atomic percent to 2 atomic percent and more preferably from 0.5 to 1 atomic percent. When Ni content was below 0.1 atomic percent, ribbon fabricability was poor. When Ni content exceeded 2 atomic percent, saturation induction and coercivity in the ribbon were reduced. In the case of Co, Co content was preferably between 0.1 atomic percent and 2 atomic percent and more preferably between 0.5 atomic percent and 1 atomic percent.

Furthermore, of the Fe substitution elements of Ni, Mn, Co, V, Cr, Ti, Zr, Nb, Mo, Hf, Ta and W discussed above, elements such as Ti, Zr, Nb, Mo, Hf, Ta and W tended to be alloyed into the amorphous phase of a heat-treated ribbon, contributing to the stability of the amorphous phase and improving the soft magnetic properties of the heat-treated ribbon. However, the atomic sizes of these elements were larger than other transition metals such as Fe and soft magnetic properties in the heat-treated ribbon were degraded when their contents were large. Therefore, the content of these elements may be below 0.4 atomic percent, preferably below 0.3 atomic percent, or more preferably below 0.2 atomic percent in total.

In the previously recited composition of $Fe_{100-x-y-z}Cu_xB_ySi_z$ ($0.6 \le x < 1.2$, $10 \le y \le 20$, $0 < z \le 10$, $10 \le (y+z) \le 24$), less than 5 atomic percent or more preferably less than 2 atomic percent of Fe denoted by $Fe_{100-x-y-z}$ may be replaced by at least one from the group of Re, Y, Zn, As, In, Sn, and rare earths elements. When a high saturation induction was desired, the contents of these elements were preferably less than 1.5 atomic percent or more preferably less than 1.0 atomic percent. The presence of these elements (including in the ranges of individual elements discussed below) may exist in combination with the aforementioned inclusion of the at least one selected from the group of Ni, Mn, Co, V, Cr, Ti, Zr, Nb, Mo, Hf, Ta and W, and with the total Fe content being in an amount greater than 75, 77 or 78 atomic percentage.

A rapidly solidified ribbon having a composition of $Fe_{100-x-y-z}Cu_xB_ySi_z$ ($0.6 \le x < 1.2$, $10 \le y \le 20$, $0 < z \le 10$, $10 \le (y+z) \le 24$) was first heat-treated by heating the ribbon with a heating rate exceeding 10° C./sec. to a predetermined holding temperature. When the holding temperature was near 300° C., the heating rate generally must exceed 10° C./sec. as it considerably affected the magnetic properties in the heat-treated ribbon. It was preferred that the holding temperature exceeded $(T_{x2}-50)$° C., where $T_{x2}$ was the temperature at which crystalline particles precipitated. It was preferred that the holding temperature was higher than 430° C. When the holding temperature was lower than 430° C., precipitation and subsequent growth of fine crystalline particles was not sufficient. The highest holding temperature, however, was lower than 530° C. which corresponded to $T_{x2}$ of the alloys of $Fe_{100-x-y-z}Cu_xB_ySi_z$ ($0.6 \le x < 1.2$, $10 \le y \le 20$, $0 < z \le 10$, $10 \le (y+z) \le 24$, $x+y+z=100$). The holding time was preferred to be less than 90 minutes or more preferred to be less than 60 minutes or even more preferred to be less than 10 minutes. The holding time may be ideally as low as the holding time for the primary annealing, the lowest of which is about 1 sec. The temperature profile for the secondary annealing with holding time of 90 minutes is depicted in FIG. 1 in which holding time of 90 minutes is indicated by "B". Some examples of the above process are given in Examples 1 and 2.

The environment of the heat-treatment given in the above paragraph may be air. However, to control the oxide layer formed during the heat-treatment, the oxygen content of the environment was preferably between 6% and 18%, or more preferably between 8% and 15% and still more preferably between 9% and 13%. The environmental atmosphere was a mixture of oxygen and inert gas such as nitrogen, argon and helium. The dew point of the environmental atmosphere was preferably below −30° C. or more preferably below −60° C.

In the heat-treatment process, a magnetic field was applied to induce magnetic anisotropy in the ribbon. The field applied was high enough to magnetically saturate the ribbon and was preferably higher than 0.8 kA/m. The applied field was either in DC, AC or pulse form. The direction of the applied field during heat-treatment was predetermined depending on the need for a square, round or linear BH loop. When the applied field was zero, a BH behavior with medium squareness ratio resulted. Magnetic anisotropy was an important factor in controlling the magnetic performance such as magnetic losses in a magnetic material and ease of controlling magnetic anisotropy by heat-treatment of an alloy of embodiments of the present invention was advantageous. Example 3 shows some of the results (FIG. 5A) obtained by the above process.

Instead of a magnetic field applied during the heat-treatment, mechanical tension was alternatively applied. This resulted in tension-induced magnetic anisotropy in the heat-treated ribbon. An effective tension was higher than 1 MPa and less than 500 MPa.

In a further modification of the process involving the field-induced magnetic anisotropy and the process involving the tension-induced magnetic anisotropy, secondary heat-treatment subsequent to the primary heat-treatments of the preceding two paragraphs was applied to a ribbon. The secondary heat-treatment was performed at the temperature between 400° C. and 500° C. and its duration was longer than 30 minutes. This additional process was found to homogenize the magnetic properties of a heat-treated ribbon. Example 3 shows some of the results (FIG. 5B) obtained by the process described above.

EXAMPLE 1

Figure 2:
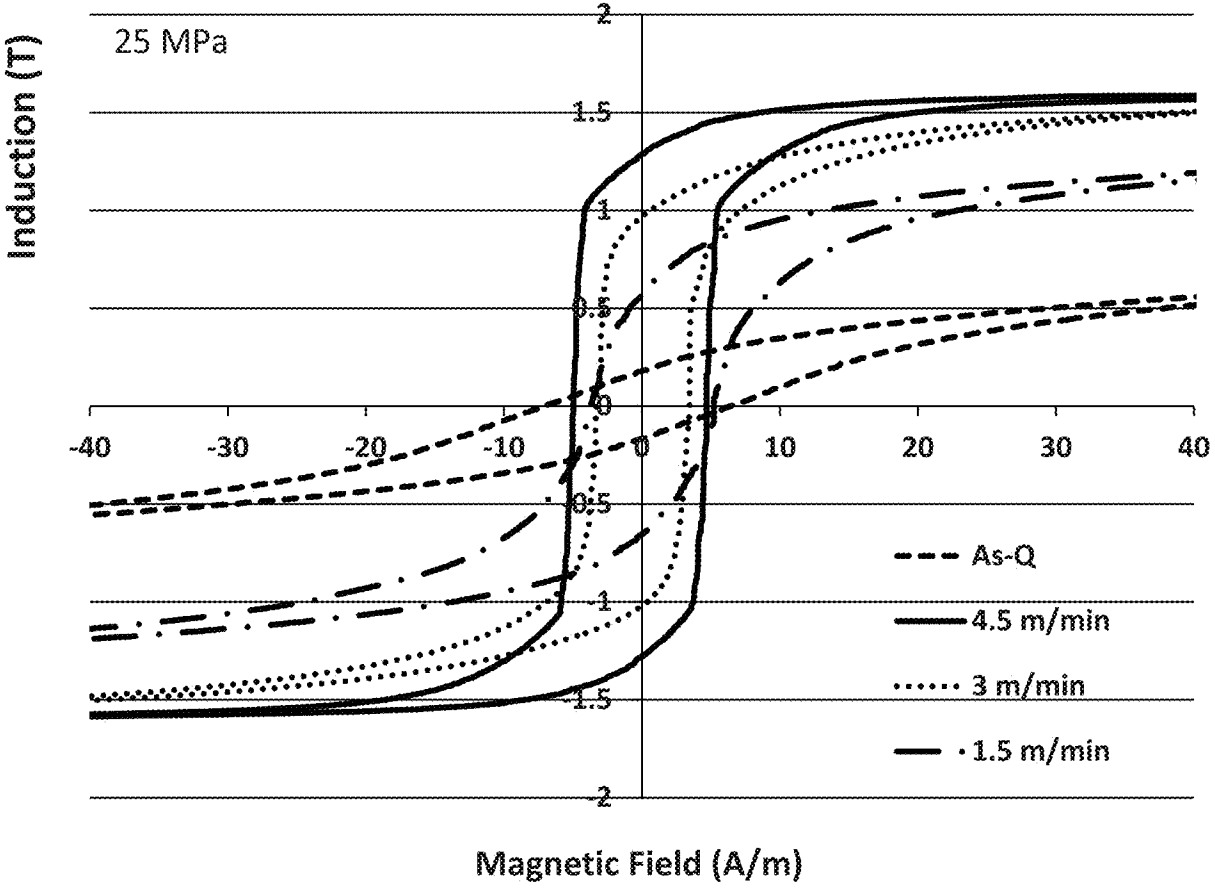
FIG. 2 illustrates the B—H behavior of a heat-treated ribbon of an embodiment the present invention, where H is the applied magnetic field and B is the resultant magnetic induction.

A rapidly-solidified ribbon having a composition of $Fe_{81}Cu_{1.0}Si_4B_{14}$ was traversed on a 30 cm-long brass plate heated at 490° C. for 3-15 seconds. It took 5-6 seconds for the ribbon to reach the brass-plate temperature of 490° C., resulting in a heating rate of 80-100° C./sec. The heat-treated ribbon was characterized by a commercial BH loop tracer and the result is given in FIG. 2, where the light solid line corresponds to the BH loop for an as-cast ribbon, and the solid line, dotted line and semi-dotted line correspond to the BH loops for the ribbon tension-annealed with speeds at 4.5 m/min., 3 m/min., and 1.5 m/min., respectively.

Figure 3A:
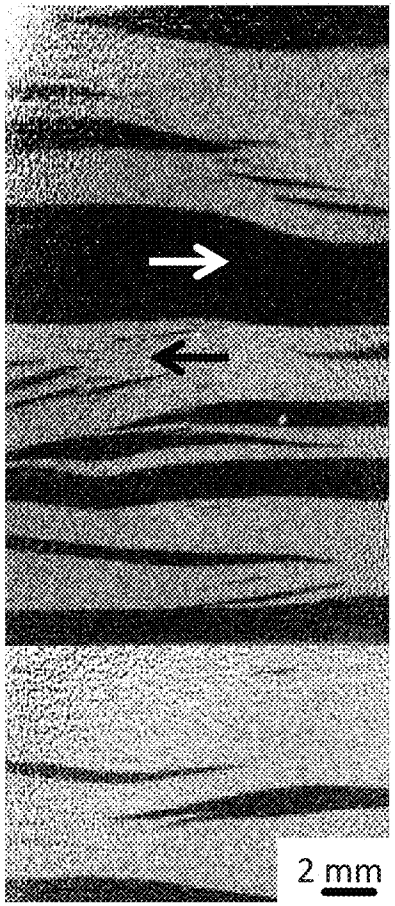
FIGS. 3A, 3B, and 3C depict the magnetic domain structures observed on flat surface (FIG. 3A), concave surface (FIG. 3B) and convex surface (FIG. 3C) of a heat-treated ribbon of the embodiment of the present invention.
Figure 3B:
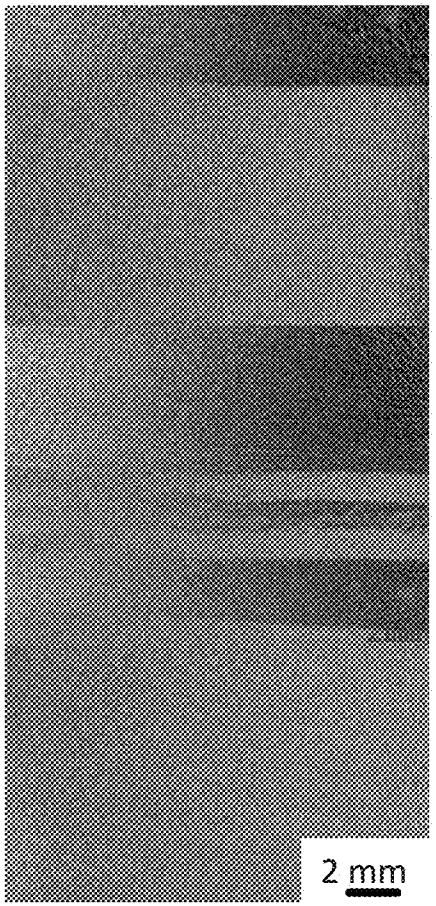
Figure 3C:
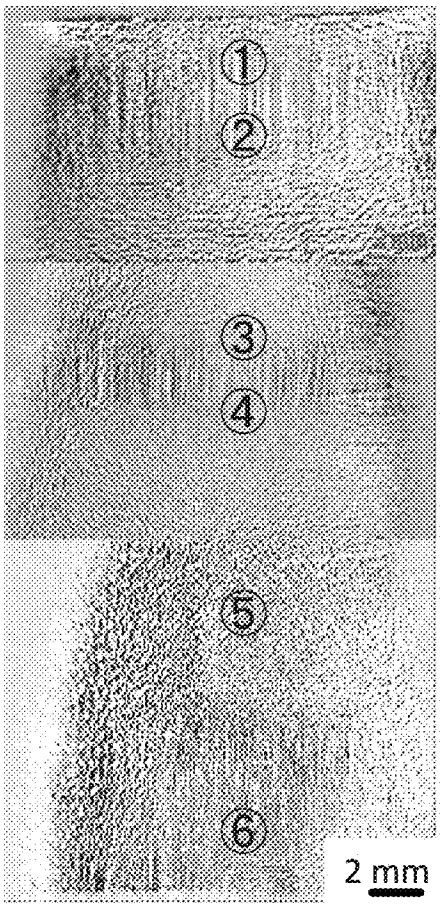

FIGS. 3A, 3B, and 3C shows the magnetic domains observed on the ribbon of Example 1 by Kerr microscopy. FIGS. 3A, 3B, and 3C are from the flat surface, from the convex and from the concave surface of the ribbon, respectively. As indicated, the direction of the magnetization in the black section points 180° away from the white section. FIGS. 3A and 3B indicate that the magnetic properties are uniform across the ribbon width and along the length direction. On the other hand, on the compressed section corresponding to FIG. 3C, local stress varies from point to point.

Figure 4:
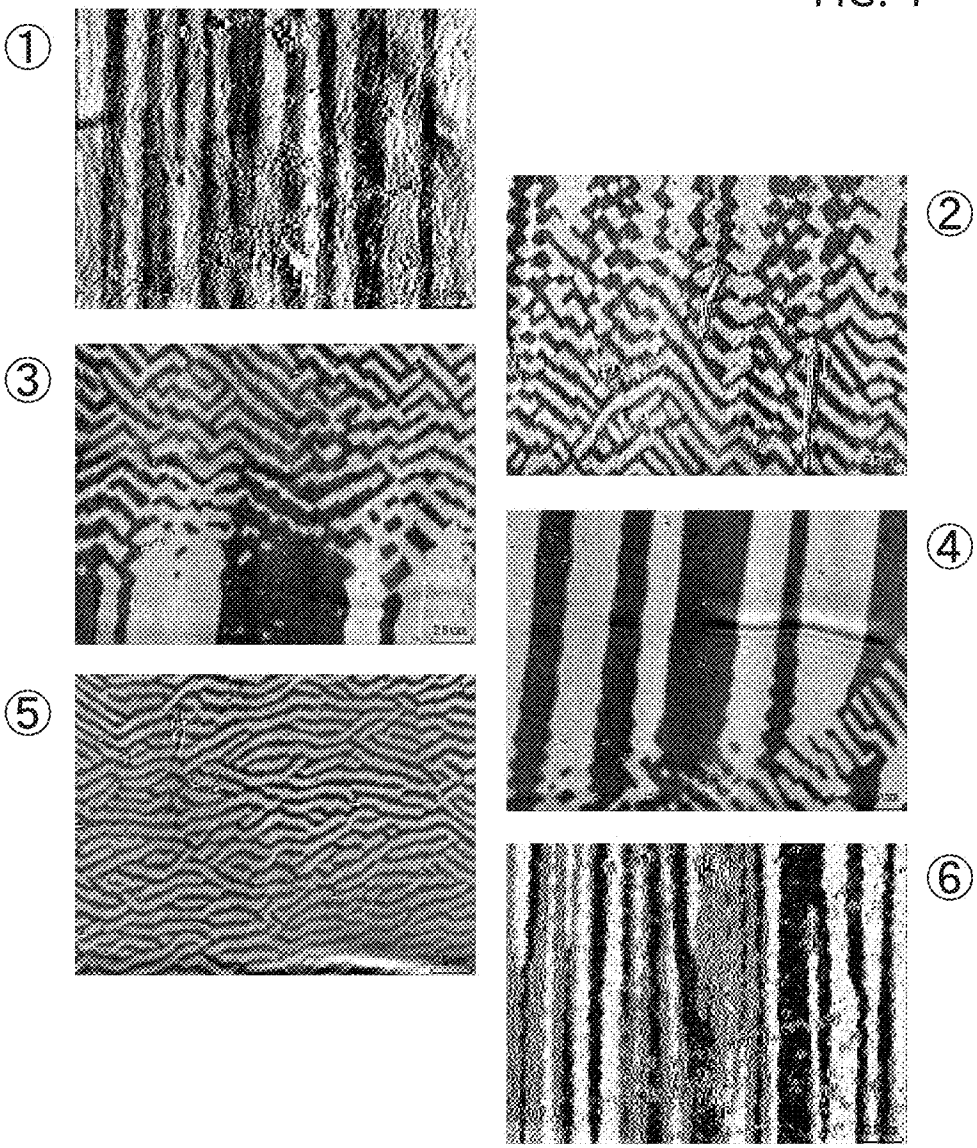
FIG. 4 shows the detailed magnetic domain patterns at points 1, 2, 3, 4, 5 and 6 indicated in FIG. 3C.

FIG. 4 shows the detailed magnetic domain patterns at ribbon section 1, 2, 3, 4, 5 and 6 in FIG. 3C. These magnetic domain patterns indicate magnetization directions near the ribbon surface, reflecting local stress distribution in the ribbon. FIGS. 2A, 2B, FIGS. 3A, 3B, and 3C each shows a scale bar of 2 mm. FIG. 4 shows a scale bar of 25 μm in each of the sub-images.

EXAMPLE 2

During first heat-treatment of ribbons according to embodiments of the present invention, a radius of curvature developed in the ribbons, although the heat treated ribbon is relatively flat. To determine the range of radius of ribbon curvature, R (mm), in a heat-treated ribbon in which $B_{80}/B_s$ was greater than 0.90, the $B_{80}/B_s$ ratio was examined as a function of ribbon radius of curvature which was changed by winding the heat treated ribbon on rounded surface with known radius of curvature. The results are listed in Table 1. The data in Table 1 are summarized by $B_{80}/B_s$=0.0028R+0.48. The data in Table 1 is used to design a magnetic core, for example, made from laminated ribbon.

TABLE 1

Radius of ribbon curvature versus $B_{80}/B_s$

| Sample | R, Radius of Ribbon Curvature (mm) | $B_{80}/B_s$ |
|---|---|---|
| 1 | ∞ | 0.98 |
| 2 | 200 | 0.92 |
| 3 | 150 | 0.89 |
| 4 | 100 | 0.72 |
| 5 | 58 | 0.65 |
| 6 | 25 | 0.55 |
| 7 | 12.5 | 0.52 |

Sample 1 corresponds to the flat ribbon case of FIG. 3A in Example 1, where the magnetization distribution is relatively uniform, resulting in a large value of $B_{80}/B_s$, which is preferred.

In embodiments of the claimed inventions, the radius of curvature can range from any value between the values given in the table above, including from a radius of curvature ranging from 200 mm to infinity, or from a radius of curvature of 200 mm to a shape in which the ribbon is flat or substantially flat. The $B_{80}/B_s$ value may, for example, be any value between 0.52 and 0.98, including values between 0.92 and 0.98.

EXAMPLE 3

Strip samples of $Fe_{81}Cu_1Mo_{0.2}Si_4B_{13.8}$ alloy ribbon were annealed first with a heating rate of more than 50° C./s in a heating bath at 470° C. for 15 sec., followed by secondary annealing at 430° C. for 5,400 sec. in a magnetic field of 1.5 kA/m. The first annealing heating rate was found to be as high as 10,000° C./sec. Strips of the same chemical composition were annealed first with a heating rate of more than 50° C./s in a heating bath at 481° C. for 8 sec. and with a tension of 3 MPa, followed by secondary annealing at 430° C. for 5,400 sec. with a magnetic field of 1.5 kA/m. Examples of BH loops taken on these strips are shown in FIGS. 5A and 5B.

Figure 5A:
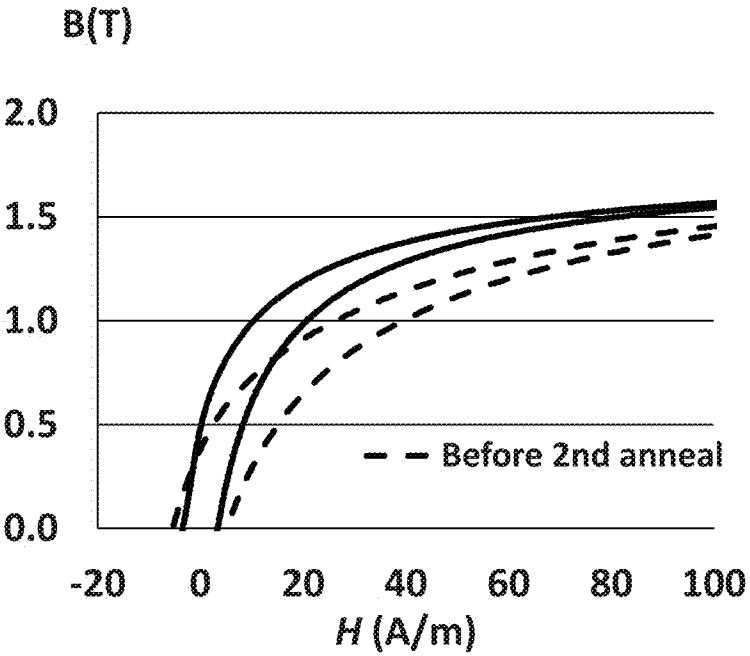
FIGS. 5A and 5B show BH behavior (FIG. 5A) taken on a sample of $Fe_{81}Cu_1Mo_{0.2}Si_4B_{13.8}$ alloy 5-ply ribbon annealed first with a heating rate of 50° C./s in a heating bath at 470° C. for 15 sec. (dotted line), followed by a secondary annealing at 430° C. for 5,400 sec. in a magnetic field of 1.5 kA/m and BH behavior (FIG. 5B) taken on a sample with the same composition annealed first with a heating rate of 50° C./s in a heating bath at 481° C. for 8 sec. and with a tension of 3 MPa (dotted line), followed by secondary annealing at 430° C. for 5,400 sec. with a magnetic field of 1.5 kA/m.
Figure 5B:
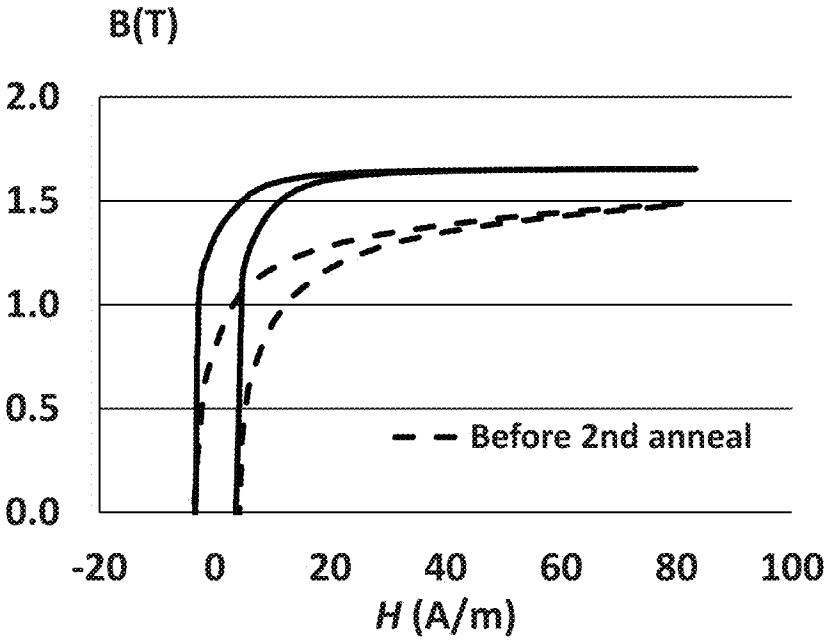

FIG. 5A shows BH behavior taken on a $Fe_{81}Cu_1Mo_{0.2}Si_4B_{13.8}$ sample annealed first with a heating rate of 50° C./s in a heating bath at 470° C. for 15 sec. (dotted line), followed by a secondary annealing at 430° C. for 5,400 sec. in a magnetic field of 1.5 kA/m. FIG. 5B shows the BH behavior taken on a sample with the same composition annealed first with a heating rate of 50° C./s in a heating bath at 481° C. for 8 sec. and with a tension of 3 MPa (dotted line), followed by secondary annealing at 430° C. for 5,400 sec. with a magnetic field of 1.5 kA/m.

EXAMPLE 4

180° bend ductility tests were taken on the alloys of the embodiment of the present invention and two alloys of the '531 publication (as comparative examples), as shown in the Table below. The 180° bend ductility test is commonly used to test if ribbon-shaped material breaks or cracks when bent by 180°. As shown, the products of the embodiments of the present invention did not exhibit failure in the bending test.

TABLE 2

| Composition | 180° bending |
|---|---|
| $Fe_{bal.}Cu_{0.6}Si_4B_{14}$ | passed |
| $Fe_{bal.}Cu_{1.0}Si_4B_{14}$ | passed |
| $Fe_{bal.}Cu_{1.1}Si_4B_{14}$ | passed |
| $Fe_{bal.}Cu_{1.15}Si_4B_{14}$ | partially possible |
| $Fe_{bal.}Cu_{0.8}Mo_{0.2}Si_{4.2}B_{13}$ | passed |
| $Fe_{bal.}Cu_{1.0}Mo_{0.2}Si_{4.2}B_{13}$ | passed |
| $Fe_{bal.}Cu_{1.0}Mo_{0.2}Si_4B_{14}$ | passed |
| $Fe_{bal.}Cu_{1.0}Mo_{0.5}Si_4B_{14}$ | passed |
| $Fe_{bal.}Cu_{1.2}Si_4B_{14}$ ('531 publication product) | failed |
| $Fe_{bal.}Cu_{1.3}Si_4B_{14}$ ('531 publication product) | failed |

As used throughout this application, the term "to" refers to inclusive endpoints. Therefore, "x to y" refers to a range including x and including y, and all points in between; such intermediate points are also part of this disclosure. Moreover, one skilled in the art would also understand that deviations in numerical quantities are possible. Therefore, whenever a numerical value is mentioned in the specification or claims, it is understood that additional values that are about such numerical value or approximately such numerical value are also within the scope of the invention.

Although a few embodiments have been shown and described, it would be appreciated by those skilled in the art that changes may be made in these embodiments without departing from the principles and spirit of the invention, the scope of which is defined in the claims and their equivalents.

What is claimed is:

1. A nanocrystalline alloy ribbon comprising:

an alloy composition represented by $Fe_{bal}$, $Cu_xB_ySi_zA_aX_b$ where 0.6 at %≤x<1.2 at %, 10 at %≤y≤20 at %, 0 at %<z≤10 at %, 10 at %<(y+z)≤24 at %, 0 at %≤a≤10 at %, 0 at %≤b≤5 at %, with or without incidental impurities, where A is an optional inclusion of at least one element selected from Ni, Mn, Co, V, Cr, Ti, Zr, Nb, Mo, Hf, Ta and W, and X is an optional inclusion of at least one element selected from Re, Y, Zn, As, In, Sn, and rare earth elements, at. % being in atomic percent, wherein a total content of Ti, Mo, Nb, Zr, Ta, Hf, and Win the alloy composition is below 0.3 atomic percent;

the nanocrystalline alloy ribbon having a heat-treated local structure including nanocrystals with average particle sizes of less than 40 nm dispersed in an amorphous matrix of the nanocrystalline alloy ribbon and occupying more than 30 volume percent of the nanocrystalline alloy ribbon, the nanocrystalline alloy ribbon exhibiting, based on the heat-treated local structure, a radius of ribbon curvature of at least 200 mm, a magnetic induction at 80 A/m exceeding 1.6 T and below 1.75 T, a coercivity $H_c$ of less than 6.5 A/m, and a core loss at 1.5 T and 50 Hz of less than 0.27 W/kg.

2. The nanocrystalline alloy ribbon according to claim 1, having a $B_{80}/B_s$ ratio of 0.92 to 0.98, where $B_{80}$ is magnetic induction at 80 A/m, and $B_s$ is saturation induction.

3. The nanocrystalline alloy ribbon according to claim 1, wherein the nanocrystalline alloy ribbon exhibits a saturation induction $B_s$ exceeding 1.7 T.

4. The nanocrystalline alloy ribbon according to claim 1, wherein a content of Fe exceeds 75 atomic percent.

5. The nanocrystalline alloy ribbon according to claim 1, wherein the alloy composition consists of Fe, Cu, B, and Si and incidental impurities.

6. The nanocrystalline alloy ribbon according to claim 1, wherein "a" ranges from 0.01 atomic percent to 10 atomic percent.

7. The nanocrystalline alloy ribbon according to claim 6, wherein "a" ranges from 0.01 atomic percent to 1.5 atomic percent.

8. The nanocrystalline alloy ribbon according to claim 2, wherein the total content of Ti, Mo, Nb, Zr, Ta, Hf, and W in the alloy composition is below 0.2 atomic percent.

9. The nanocrystalline alloy ribbon according to claim 1, wherein b is less than 2.0 atomic percent.

10. The nanocrystalline alloy ribbon according to claim 1, wherein b is less than 1.0 atomic percent.

11. A nanocrystalline alloy ribbon comprising:

an alloy composition represented by $Fe_{bal}$, $Cu_xB_ySi_zA_aX_b$ where 0.6 at %≤x<1.2 at %, 10 at %≤y≤20 at %, 0 at %<z≤10 at %, 10 at %<(y+z)≤24 at %, 0 at %≤a≤10 at %, 0 at %≤b≤5 at %, with or without incidental impurities, where A is an optional inclusion of at least one element selected from Ni, Mn, Co, V, Cr, Ti, Zr, Nb, Mo, Hf, Ta and W, and X is an optional inclusion of at least one element selected from Re, Y, Zn, As, In, Sn, and rare earth elements, at. % being in atomic percent, wherein a total content of Ti, Mo, Nb, Zr, Ta, Hf, and Win the alloy composition is below 0.3 atomic percent;

the nanocrystalline alloy ribbon having a heat-treated local structure including nanocrystals with average particle sizes of less than 40 nm dispersed in an amorphous matrix of the nanocrystalline alloy ribbon and occupying more than 30 volume percent of the nanocrystalline alloy ribbon, based on heat-treatment of the nanocrystalline alloy ribbon at an average heating rate of more than 50° C./sec. from at least room temperature, wherein the nanocrystalline alloy ribbon exhibits, based on the heat-treated local structure, a magnetic induction at 80 A/m exceeding 1.6 T and below 1.75 T.

12. The nanocrystalline alloy ribbon according to claim 11, wherein the heat-treatment of the nanocrystalline alloy ribbon at the average heating rate of more than 50° C./sec. from at least room temperature includes:

heating-treating the nanocrystalline alloy ribbon at the average heating rate of more than 50° C./sec. from 300° C. to a predetermined holding temperature which exceeds 450° C. and which is less than 520° C., and then holding at the predetermined holding temperature for a holding time of less than 10 minutes.

13. The nanocrystalline alloy ribbon according to claim 11, wherein the heat-treatment of the nanocrystalline alloy ribbon at the average heating rate of more than 50° C./sec. from at least room temperature includes using a magnetic field applied during the heat-treatment of the nanocrystalline alloy ribbon, the magnetic field applied being high enough to magnetically saturate the nanocrystalline alloy ribbon and being in DC, AC or pulse form, and a direction of the applied magnetic field having been predetermined depending on a need for a square, round or linear BH loop.

14. The nanocrystalline alloy ribbon according to claim 11, wherein the heat-treatment of the nanocrystalline alloy ribbon at the average heating rate of more than 50° C./sec. from at least room temperature includes applying a mechanical tension higher than 1 MPa and less than 500 MPa to the nanocrystalline alloy ribbon during the heat-treatment.

15. The nanocrystalline alloy ribbon according to claim 11, wherein the heat-treatment of the nanocrystalline alloy ribbon at the average heating rate of more than 50° C./sec. from at least room temperature includes a secondary heat-treatment performed at a temperature from 400° C. to 500° C. for a duration shorter than 30 minutes.

16. A nanocrystalline alloy ribbon comprising:

an alloy composition represented by $Fe_{bal}$, $Cu_xB_ySi_zA_aX_b$ where 0.6 at %≤x<1.2 at %, 10 at %≤y≤20 at %, 0 at %<z≤10 at %, 10 at %<(y+z)≤24 at %, 0 at %≤a≤10 at %, 0 at %≤b≤5 at %, with or without incidental impurities, where A is an optional inclusion of at least one element selected from Ni, Mn, Co, V, Cr, Ti, Zr, Nb, Mo, Hf, Ta and W, and X is an optional inclusion of at least one element selected from Re, Y, Zn, As and In, and rare earth elements, at. % being in atomic percent, wherein a total content of Ti, Mo, Nb, Zr, Ta, Hf, and Win the alloy composition is below 0.3 atomic percent;

the nanocrystalline alloy ribbon having a heat-treated local structure including nanocrystals with average particle sizes of less than 40 nm dispersed in an amorphous matrix of the nanocrystalline alloy ribbon and occupying more than 30 volume percent of the nanocrystalline alloy ribbon, the nanocrystalline alloy ribbon exhibiting, based on the heat-treated local structure, a radius of ribbon curvature of at least 200 mm, a $B_{80}/B_s$ ratio of 0.92 to 0.98, where $B_{80}$ is magnetic induction at 80 A/m, and $B_s$ is saturation induction, a magnetic induction at 80 A/m exceeding 1.6 T and below 1.75 T, a coercivity $H_c$ of less than 6.5 A/m, and a core loss at 1.5 T and 50 Hz of less than 0.27 W/kg.

17. The nanocrystalline alloy ribbon according to claim 1, wherein the nanocrystalline alloy ribbon exhibits a saturation induction $B_s$ exceeding 1.7 T.

18. The nanocrystalline alloy ribbon according to claim 1, wherein a content of Fe exceeds 75 atomic percent.

19. The nanocrystalline alloy ribbon according to claim 1, wherein the alloy composition consists of Fe, Cu, B, and Si and incidental impurities.

20. The nanocrystalline alloy ribbon according to claim 1, wherein "a" ranges from 0.01 atomic percent to 10 atomic percent.

21. The nanocrystalline alloy ribbon according to claim 6, wherein "a" ranges from 0.01 atomic percent to 1.5 atomic percent.

22. The nanocrystalline alloy ribbon according to claim 2, wherein the total content of Ti, Mo, Nb, Zr, Ta, Hf, and W in the alloy composition is below 0.2 atomic percent.

23. The nanocrystalline alloy ribbon according to claim 1, wherein b is less than 2.0 atomic percent.

24. The nanocrystalline alloy ribbon according to claim 1, wherein b is less than 1.0 atomic percent.

* * * * *